US006220697B1

(12) United States Patent
Yamanaka et al.

(10) Patent No.: US 6,220,697 B1
(45) Date of Patent: Apr. 24, 2001

(54) INK JET RECORDING HEAD AND INK JET RECORDING APPARATUS HAVING SUCH HEAD

(75) Inventors: Akihiro Yamanaka; Kazuaki Masuda, both of Kawasaki; Hajime Yamamoto, Yokohama; Eiichiro Shimizu, Urawa; Yasuo Kotaki, Yokohama; Teruo Arashima; Jun Hinami, both of Kawasaki; Wataru Takahashi, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/919,335

(22) Filed: Aug. 28, 1997

(30) Foreign Application Priority Data

| | | |
|---|---|---|
| Aug. 30, 1996 | (JP) | 8-230415 |
| Aug. 30, 1996 | (JP) | 8-230447 |
| May 2, 1997 | (JP) | 9-114756 |

(51) Int. Cl.[7] ..... B41J 2/05
(52) U.S. Cl. ..... 347/63
(58) Field of Search ..... 347/33, 417, 40, 347/42, 63, 20, 43

(56) References Cited

U.S. PATENT DOCUMENTS

| | | | | |
|---|---|---|---|---|
| 4,380,771 | * | 4/1983 | Takatori | 347/44 |
| 4,803,499 | | 2/1989 | Hayamizu | 346/140 R |
| 4,860,033 | | 8/1989 | Shiozaki et al. . | |
| 4,994,825 | | 2/1991 | Saito et al. . | |
| 5,095,321 | | 3/1992 | Saito et al. . | |
| 5,208,604 | | 5/1993 | Watanabe et al. . | |
| 5,262,802 | | 11/1993 | Karita et al. . | |
| 5,347,713 | | 9/1994 | Shibata et al. . | |
| 5,361,087 | | 11/1994 | Tajima et al. . | |
| 5,381,169 | * | 1/1995 | Arai et al. | 347/33 |
| 5,389,957 | | 2/1995 | Kimura et al. . | |
| 5,485,184 | | 1/1996 | Nakagomi et al. . | |
| 5,612,722 | * | 3/1997 | Francis et al. | 347/33 |
| 5,650,807 | | 7/1997 | Abe et al. | 347/43 |
| 5,657,539 | | 8/1997 | Orikasa et al. . | |

FOREIGN PATENT DOCUMENTS

| | | | | |
|---|---|---|---|---|
| 0 581 298 | | 2/1994 | (EP) . | |
| 0 644 051 | | 3/1995 | (EP) . | |
| 0 659 573 | | 6/1995 | (EP) . | |
| 0 694 400 | | 1/1996 | (EP) . | |
| 2134041 | * | 8/1984 | (GB) | 347/44 |

OTHER PUBLICATIONS

IBM Technical Disclusure Bulletin, vol. 30, No. 7, Dec. 1987.*

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

The present invention provides an ink jet recording head comprising a top plate in which two groups of ink passage grooves for forming ink passages, two ink chamber frames, ink introduction passages, two rows of ink discharge ports are formed, two substrates on which a plurality of resistive heat generating elements for discharging ink are formed in correspondence to the two rows of ink discharge ports, and two elastic members for contacting under pressure and securing the substrates and the top plate for each said substrate, and wherein the junction between the substrates and the top plate forms the ink passages and the ink chambers therebetween, and further wherein a groove for isolating the ink discharge port rows from each other is formed between the ink discharge port rows and a depth of the groove is greater than depths of the ink discharge ports and the ink passages.

21 Claims, 10 Drawing Sheets

INK JET RECORDING HEAD AND INK JET RECORDING APPARATUS HAVING SUCH HEAD

BACKGROUND OF THE INVENTION

1. Field of the Invention

The present invention relates to an ink jet recording head and a recording apparatus having such an ink jet recording head.

2. Related Background Art (1) Almost all of ink jet recording apparatuses of this kind are generally connected to a word processor or a personal computer and are used as a color printer, a facsimile, a copying machine or the like.

Conventional ink jet recording heads used in color printers are generally grouped into three types, i.e., a one-head type in which an ink discharge portion of a single recording head is divided into colors (black, yellow, magenta and cyan). This type having an advantage that the head becomes cheaper although the number of nozzles per color is reduced, a multi-head type in which independent recording heads for respective colors are disposed side by side when printing is performed, this type having an advantage that the number of nozzles per color is increased, although the cost becomes higher, and a head unit type in which independent ink discharge portions for respective colors are incorporated into a single base.

In the one-head type, since the discharge ports for four colors can be formed in a single orifice plate, so long as manufacturing accuracy is ensured, assembling accuracy is not critical. Thus, positional accuracy of discharge ports for each color is improved to minimize print deviation, and the number of parts can be reduced to make the entire head more compact.

In the multi-head type, common parts can be used for respective heads, and the entire recording head can be easily manufactured because of simplicity of each head. However, since the plurality heads are arranged side by side, the entire recording head is made bulky and heavier.

In the head unit type, after positional deviation of ink droplets discharged from discharge ports of the orifice plates for respective color was measured and then such deviation was corrected, such orifice plate are incorporated into the base with high accuracy on the basis of the correction. Thus, the color deviation can be minimized. Further, replacement of heads can be easily performed because the heads are integrated as the unit. In addition, since a large number of discharge ports are associated with each color, high speed recording can be achieved.

In the conventional techniques, a wiring substrate including connection pads to be connected to the head(s) is secured to an ink container or a top plate. The top plate is secured to a substrate on which resistive heating elements are formed by adhesive or springs. When the springs are used, the top plate is rested on the substrate on which the resistive heating elements are formed and is secured to a base plate and the spring is mounted on the top plate.

In view of compactness and high speed recording which are required for an ink jet recording head of a color printer, the one-head type and the head unit type will be expected more and more from now.

(2) On the other hand, since the ink jet recording method can provide a compact, light-weighted and cheap recording apparatus in which recording noise can be minimized and plain paper sheets can be used more easily than the other recording methods, many low cost printers utilize such ink jet recording method. Among the ink jet recording methods, a bubble jet recording method has recently been used since a large number of ink jet discharge ports can be arranged in an ink jet recording head with high density.

In already known ink jet printers, ink supply is effected in the following two manners. In the first manner, the ink jet recording head is mounted on a carriage and an ink tank having large capacity (volume) is disposed at a predetermined position on a recording apparatus, and ink is supplied from the ink tank to the ink jet recording head through an ink tube.

In this arrangement, the running cost is very cheap. However, since it is required that a service life of the ink jet recording head itself is equal to or longer than a service life of the printer, the structure and material of the ink jet recording head must be devised, and, thus, the ink jet recording head itself tends to be expensive.

In the second manner, an ink tank and an ink jet recording head are integrated as an ink jet unit which is in turn detachably mounted on a carriage. In this arrangement, a long ink tube is not required, replacement of ink can easily be performed, and the entire apparatus can be made compact. However, at a time when the ink in the ink tank is used up, since both the ink tank and ink jet recording head must be replaced or exchanged, the running cost becomes expensive. Particularly, in such a case, since the ink jet recording head a service life of which has not yet been expired is also discarded, this is not preferred in view of ecology.

In order to eliminate the drawbacks associated with the above-mentioned two manners, there has been proposed an arrangement in which an ink jet recording head and an ink tank are detachably mounted on a carriage independently, as disclosed in Japanese Patent Laid-open No. 63-004953 (1988), for example. With this arrangement, since the ink jet recording head and the ink tank can be replaced independently, it is effective to reduce the running cost.

(a) However, in the above-mentioned one-head type described in the above item (1), there arises the following problem. That is to say, since the resistive heat generating elements provided on the substrate are allotted to respective colors, the number of resistive heat generating elements associated with each color is reduced, thereby making high speed recording impossible.

In the above-mentioned head unit type described in the above item (1), there arises the following problem. That is to say, when finer color image output is desired, since positional deviation between adhesion points (on a recording medium) of color ink droplets must be minimized, the orifice plates for respective colors must be assembled with high accuracy and the orifice plates must be secured to the base with high accuracy. Thus, the assembling time is increased and an expensive assembling machine must be used. Further, fundamentally, since several recording heads are arrange side by side, the size of the head unit is increased and the number of parts is also increased.

Further, since the wiring substrate including the connection pads is secured to an attachment member other than the ink tank or the top plate, the heads cannot be detached from the ink tank and thus the heads is obliged to be discarded together with the ink tank, and the number of parts is increased due to the presence of the attachment member. When the top plate is secured to the substrate having the resistive heat generating elements by using the springs, although the assembling operation can be facilitated, since the assembling is effected on the base plate, the number of parts is increased and the assembling time is also increased. Further, in order to assemble the substrate on which the plurality of resistive heat generating elements are formed on the base plate, the entire size is increased and the assembling time is also increased.

(b) In the arrangement in which the ink jet recording head is detachably mounted on the carriage and the ink tank is detachably connected to the ink jet recording head as described in the above item (2), it is necessary to design the ink jet recording head and the ink jet unit in consideration of the following precautions. That is to say, preventing reduction of electrical reliability due to adhesion of ink and/or paper powder;

improving accuracy of attachment of the ink jet recording head to the carriage and facilitating replacement of the ink tank;

improving positioning accuracy between the ink jet recording heads for effecting color recording; and facilitating the manufacture of the ink jet recording head.

SUMMARY OF THE INVENTION

The present invention aims to eliminated the conventional drawbacks pointed out in the above items (a) and (b). To eliminate the conventional drawbacks pointed out in the above item (a), an object of the present invention is to provide an ink jet recording head in which color deviation caused by dispersion in accuracy of adhering points of ink droplets can be prevented to improve image quality of a fine color image, high speed recording can be performed and the number of parts is reduced and which is compact and reliable.

To eliminate the conventional drawbacks pointed out in the above item (b), another object of the present invention is to provide an ink jet recording head, an ink jet unit and an ink jet recording apparatus, which is compact and cheap and in which operability and reliability can be improved.

A further object of the present invention is to provide in an ink jet recording head, an ink jet unit and an ink jet recording apparatus, in which, even when an ink tank is mounted on and dismounted from the ink jet recording head in a condition that the ink jet recording head is mounted on the ink jet recording apparatus, positional deviation between the heads which would affect a bad influence upon color recording can be prevented to record a high quality image.

To achieve the above objects, according to the present invention, there is provided an ink jet recording head comprising a top plate in which two groups of ink passage grooves for forming ink passages, two ink chamber frames, ink introduction passages, two rows of ink discharge ports are formed, two substrates on which a plurality of resistive heat generating elements for discharging ink are formed in correspondence to the two rows of ink discharge ports, and two elastic members for contacting under pressure and securing the substrates and the top plate for each said substrate, and wherein the junction between the substrate and the top plate forms the ink passages and the ink chambers therebetween, and further wherein a groove for isolating the ink discharge port rows from each other is formed between the ink discharge port rows and a depth of the groove is greater than depths of the ink discharge ports and the ink passages.

In the ink jet recording head, an electrical connection surface may be provided in a plane perpendicular to an ink discharging direction of the head or inclined with respect to the ink discharging direction by ±5 degrees or less, and an ink discharge surface may be protruded toward a recording material with respect to the electrical connection surface by 5 mm or more.

With the arrangement as mentioned above, the following advantages can be obtained.

(A) In the ink jet recording head, the plurality of substrates having the resistive heat generating elements are urged against the top plate having the ink passages and the ink chambers by means of the elastic members. By manufacturing the top plate accurately and by forming the ink discharge ports with high accuracy by a laser beam by utilizing a reference surface formed on the top plate as a reference, color deviation can be prevented to improve recording quality and image quality, the number of parts can be reduced, an assembling time can be shortened, reliability and yield can be improved, and size can be reduced to provide a compact printer. Further, since the plurality of substrates having resistive heat generating elements are used, high speed recording can be achieved. In addition, since the groove (recess) having the depth greater than those of the ink passages is formed between the ink discharge port rows, the substrates can be closely contacted with the top plate effectively.

(B) Since the ink discharge surface is not flush with the electrical connection surface and an ink supply surface, reliability can be improved, and, by arranging two ink discharge port rows at positions diametrically opposed to each other around a center between two ink discharge port rows, "cost-down" can be achieved because common parts can be used. Further, by connecting the ink supply portions to the head along the ink discharge direction, when the ink tank is mounted on and dismounted from the head, load acting on the head is distributed along the rows of the ink discharge ports uniformly, thereby preventing positional deviation of the head which would affect a bad influence upon the color recording.

DETAILED DESCRIPTION OF THE PREFERRED EMBODIMENTS

The present invention will now be explained in connection with embodiments thereof with reference to the accompanying drawings.

[First Embodiment]

Figure 1:
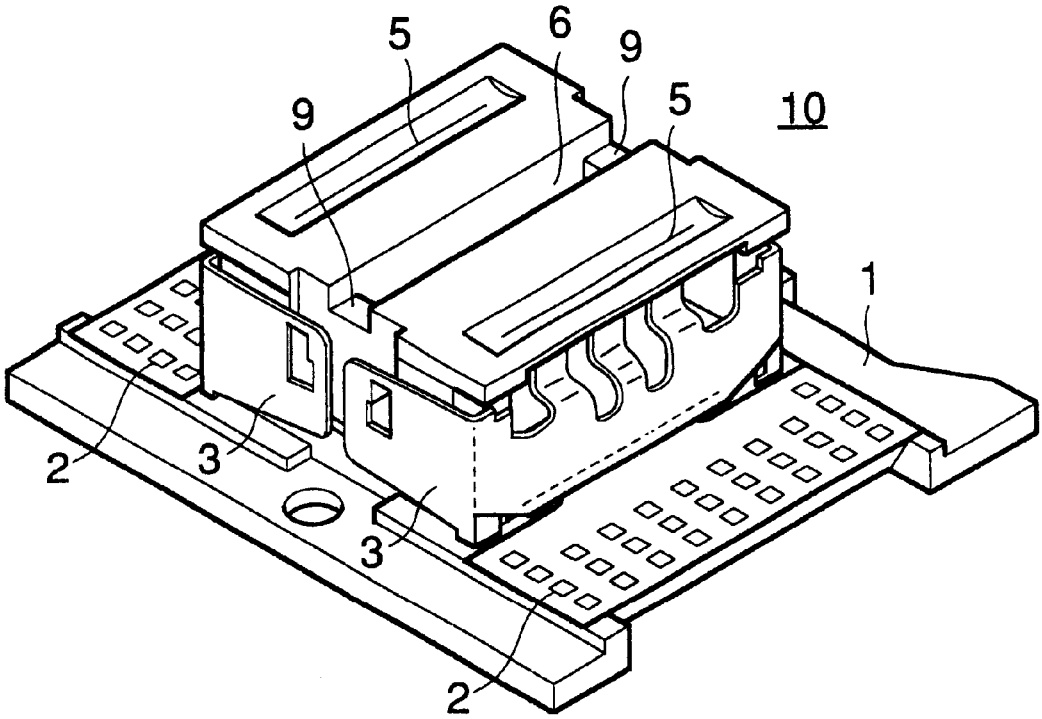
FIG. 1 is a schematic perspective view of an ink jet head according to a first embodiment of the present invention.

FIG. 1 is a schematic perspective view of an ink jet head 10 according to a first embodiment of the present invention (in this embodiment, two rows of ink discharge ports are provided). In FIG. 1, ink passage grooves (defining ink passages), ink chambers and ink discharge ports are previously formed in a top plate 1. Substrates on which resistive heat generating elements are mounted are electrically connected to a carriage by wiring substrates 2. The substrates having the heat generating elements are urged against and secured to the top plate 1 by elastic members 3. Ink discharge ports 5 are formed in the top plate 1, and a recess 6 having ribs 9 is formed in the top plate 1 at a central portion thereof.

In this embodiment, since two rows of ink discharge ports 5 can be formed symmetrically with each other and ink introduction passages are collectively formed at a certain position, the top plate can be manufactured and assembled more easily than a top plate having three or more rows of ink discharge ports.

Figure 2:
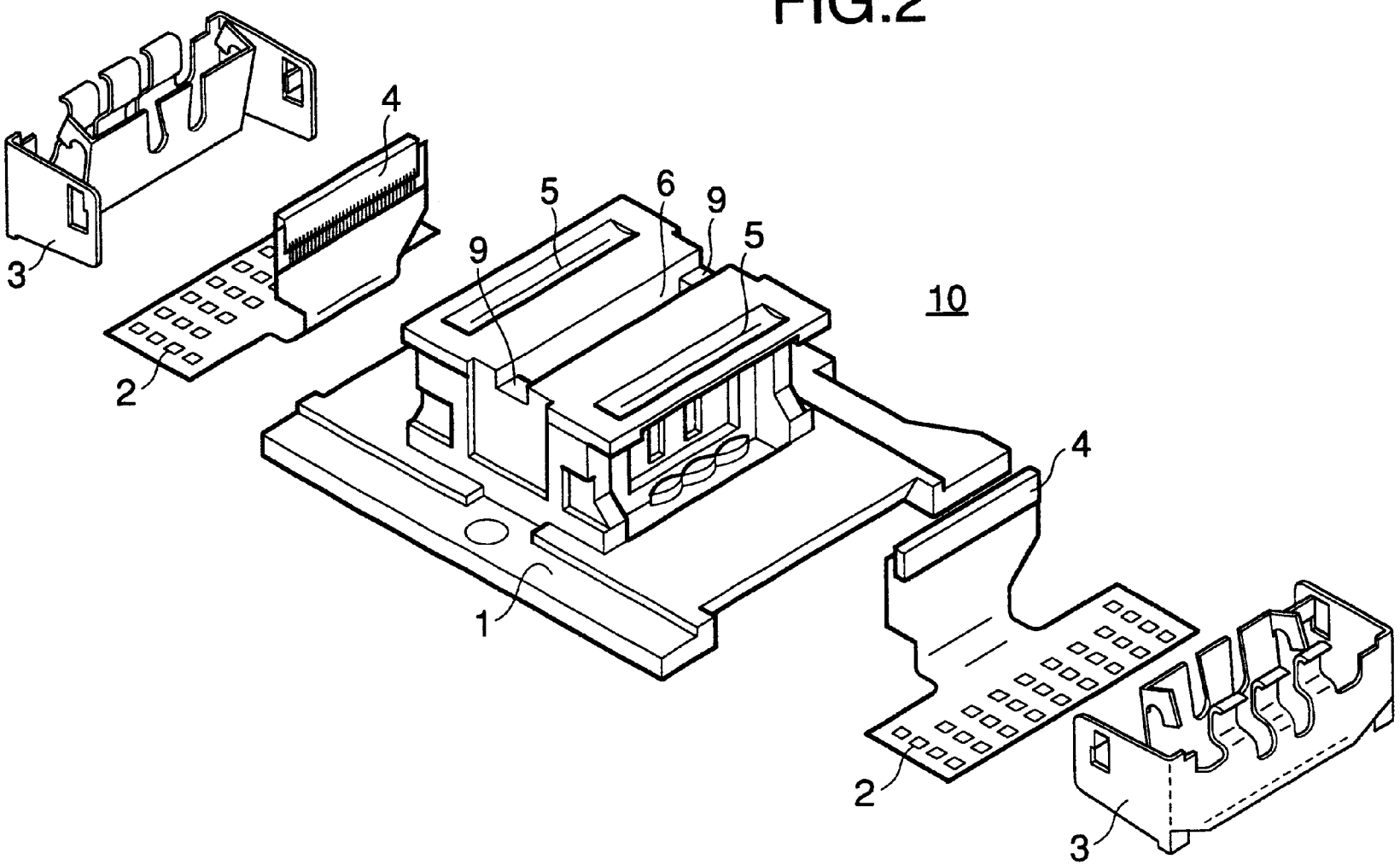
FIG. 2 is an exploded perspective view of the ink jet head of FIG. 1.

FIG. 2 is an exploded perspective view showing a detailed structure of the ink jet head 10 of FIG. 1 to facilitate the understanding of parts and an assembling method therefor. In FIG. 2, the substrates 4 having the resistive heat generating elements are electrically connected to the respective wiring substrates 2.

Figure 3:
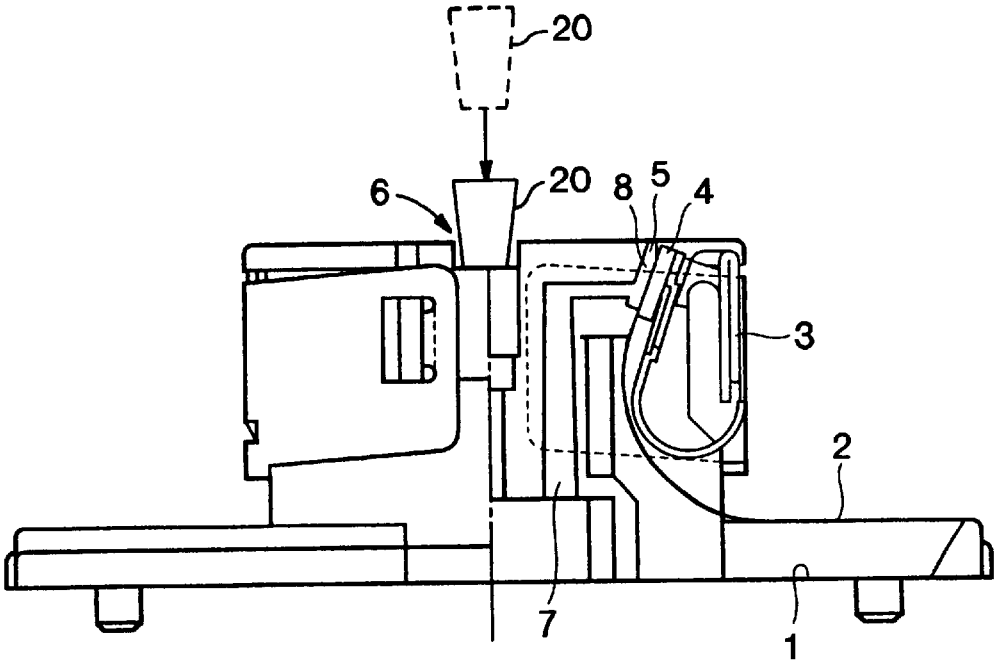
FIG. 3 is a sectional view showing an internal structure of the ink jet head of FIG. 1.
Figure 4:
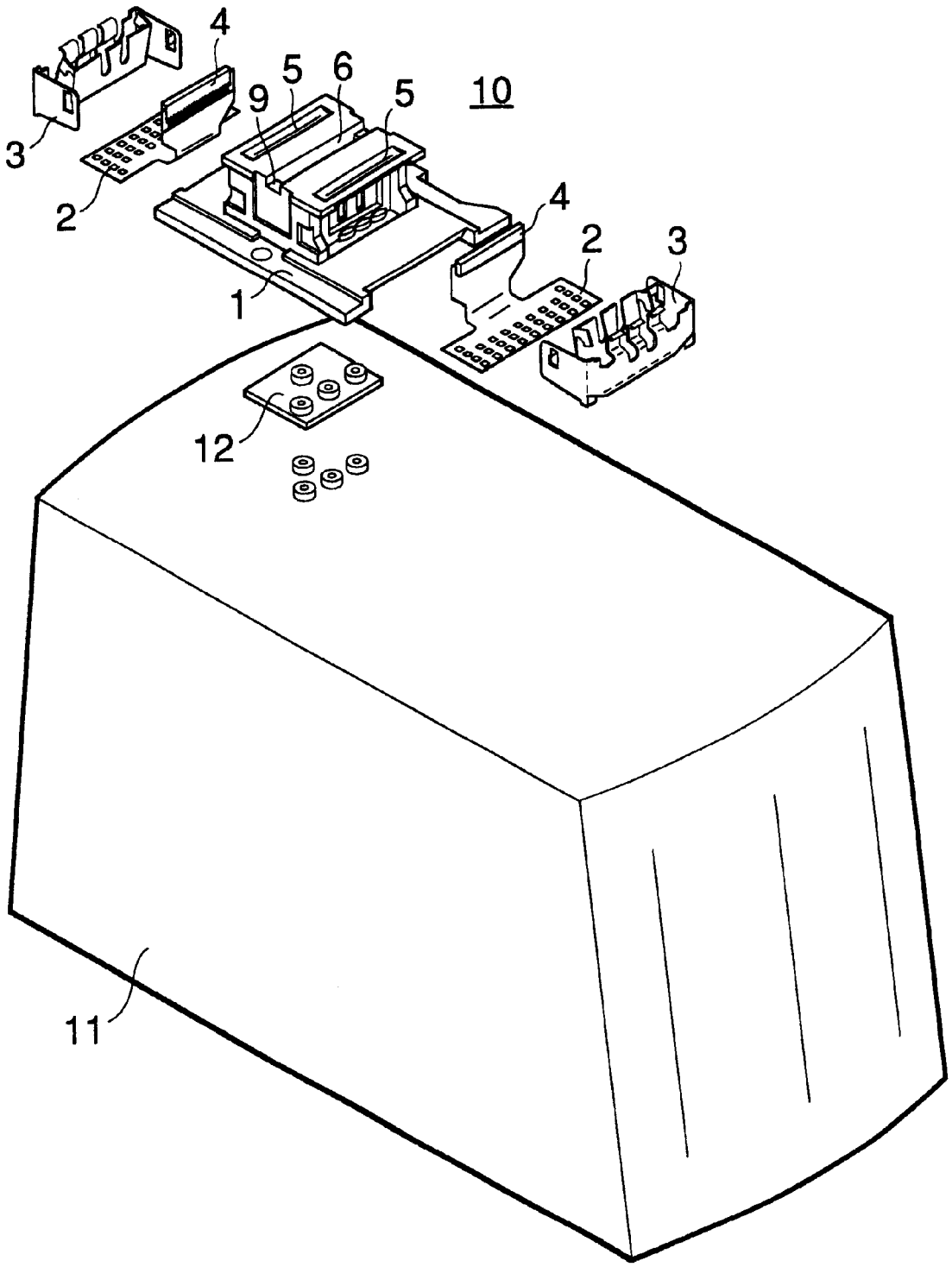
FIG. 4 is a schematic perspective view of a head unit having the ink jet head of FIG. 1.

FIG. 3 is a sectional view of the ink jet head 10 of FIG. 1, showing an internal structure thereof and ink passages. In FIG. 3, an ink introduction passage 7 serves to ink from an ink container 11 to an ink chamber 8. The ink from the ink container 11 passes through the ink introduction passage 7 and enters into the ink chamber 8 defined by the top plate 1 and the substrates 4 having the resistive heat generating elements, and flows (from the ink chamber 8) into ink passages within which the respective resistive heat generating elements are disposed. Film-boiling is caused in the ink in the ink passage by thermal energy from the resistive heat generating element, thereby discharging the ink from the discharge port 5.

In order to prevent the ink from leaking from the ink chamber 8 defined by the top plate 1 and the substrates 4 having the resistive heat generating elements, interfaces between the top plate and the substrates are sealed by sealing agent. Further, sealing agent is applied to connection portions between the substrates 4 having the resistive heat generating elements and the wiring substrates 2, thereby preventing the ink from adhering to the connection portions.

The top plate 1 is molded from resin, and the ink discharge ports 5, ink passages, ink chambers and ink introduction passages 7 are formed by molding or laser-working. Since the ink discharge ports 5 and the ink passages must be formed with high accuracy, they are preferably formed by the laser-working.

When angular deviation of the ink discharge ports 5 in each row with respect to the ink discharging direction is minimized, the distances between the ink discharge ports 5 and the recording material are changed, since the relative adhesion points of the ink droplets (onto the recording material) from each row are unchanged, electrical correction can be omitted, and, thus, electrical simplicity can be achieved. To this end, surface-finish around the ink discharge ports 5 is effected uniformly by enhancing the manufacturing accuracy. The molded parts are formed from material having good molding ability and good resistance to ink. In this respect, polysulfon is desirable, but other molding materials may be used.

The substrates 4 having the resistive heat generating elements serves to cause the film-boiling in the ink by utilizing thermal energy to effect the recording. The plurality of resistive heat generating elements arranged in a line and aluminium wirings for supplying electric power to the respective resistive heat generating elements are formed on the respective substrate made of silicon by a film-forming technique. Each substrate includes shift registers and driving transistors to reduce the number of TAB connecting pads. It is necessary that the substrates 4 and the top plate 1 are assembled with each other with high accuracy.

Each wiring substrate 2 serves to electrically connect the corresponding substrate 4 to the printer (ink jet recording apparatus). One end of the wiring substrate 2 is connected to the corresponding substrate 4 via a TAB and the other end is provided with a connection pad portion for receiving an electrical signal from the printer. The connection pad portion is secured to the top plate 1 with high accuracy by adhesive. Hence, since the head can be handled as a single unit, the assembling can be facilitated, and the "recycle" is permitted. The substrates 4 having the resistive heat generating elements are secured to the top plate 1 by mechanical biasing forces of the elastic members 3.

With the arrangement as mentioned above, the substrates 4 are closely contacted with the top plate 1 by means of the elastic members 3. To achieve the complete close contact between the substrates 4 and the top plate 1, the top plate 1 must be deformed finely, because, it is impossible that interfaces between the substrates 4 and the top plate 1 are made flat completely and thus any gaps (in the order of several $\mu$m) are created between the substrates and the top plate.

In the illustrated embodiment, by providing a groove (recess) 6 having a depth greater than those of the ink discharge portions (i.e., depths of the ink discharge ports and depths of the ink passages) between two ink discharge port rows, the ink discharge portions of the top plate corresponding to the substrates 4 can easily be deformed to achieve the complete contact between the substrates and the top plate.

Further, in the illustrated embodiment, ribs 9 are formed at both longitudinal ends of the recess 6 to facilitate the deformation of portions of the top plate on which the ribs are not formed, thereby ensuring the close contact between the substrates and the top plate.

That is to say, the illustrated embodiment can be suitably applied to a case where, when the top plate 1 is connected to the substrates 4 without any external force, gaps are created between the top plate and the substrates.

When the ribs are formed at both longitudinal ends of the recess, gaps are often created at central portions of the substrates. To avoid this, after the substrates are urged against the top plate by the elastic members, a wedge member 20 is wedged into the recess at a position corresponding to the central portions of the substrate so that the central portions of the substrates are urged toward the top plate by the wedge member 20, thereby enhancing the close contacting ability between the substrates and the top plate. The wedge member 20 may be formed from any material having hardness equal to or greater than hardness of the top plate; when the wedge member 20 is formed from material same as that of the top plate, since there is no difference in thermal expansion, the uniform close contact can be achieved.

In the illustrated embodiment, when two rows of ink discharge ports are used for discharging different color inks, the recess (groove) formed between the ink discharge port rows helps to prevent mixing of colors during the cleaning of the ink discharge surfaces. This will be explained hereinbelow.

First of all, an ink jet recording apparatus on which the aforementioned ink jet head is mounted will be described with reference to FIG. 13.

Figure 13:
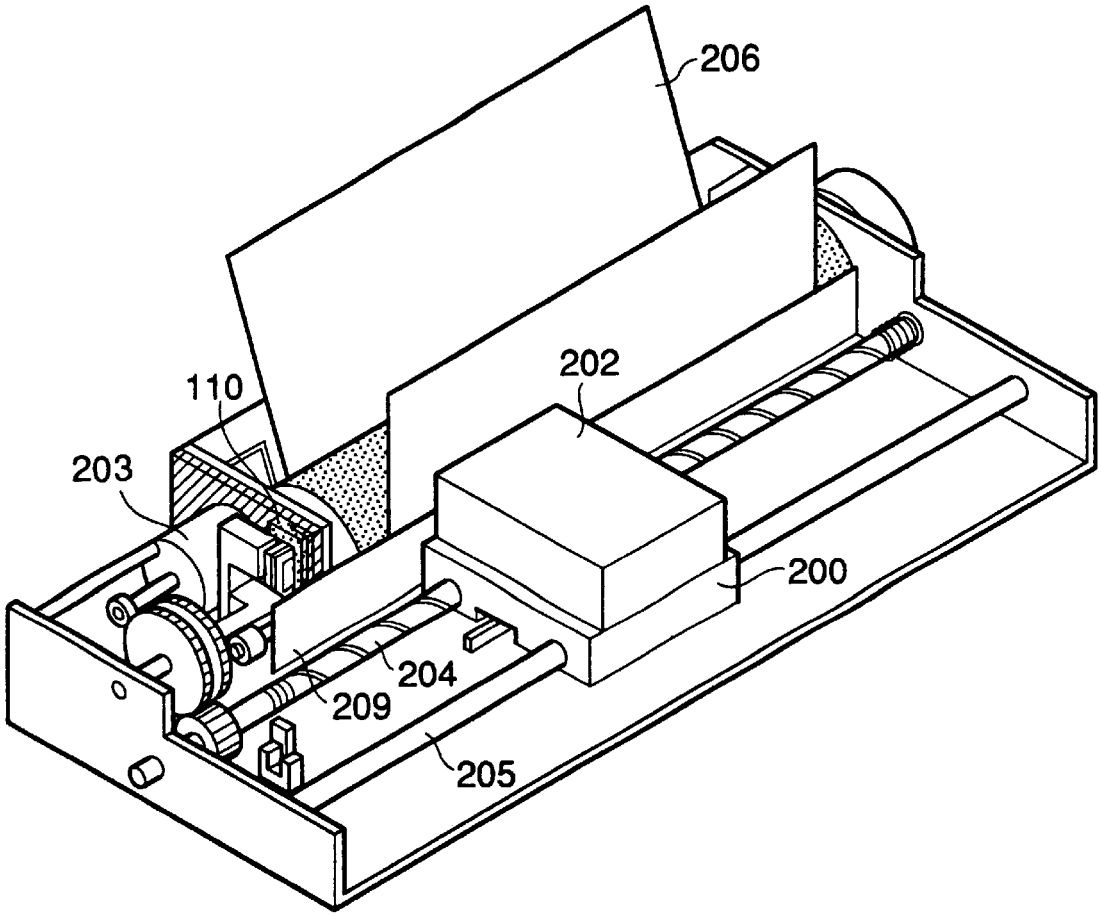
FIG. 13 is a perspective view of an ink jet recording apparatus.

In an arrangement shown in FIG. 13, a carriage 200 is reciprocally shifted on a guide shaft 205 by means of a lead screw 204 driven by a carriage motor 203.

A recording head 202 including a head and an ink tank is secured to the carriage 200, and ink discharged from the recording head is adhered onto an opposed recording medium or recording sheet 206, thereby forming an image on the recording sheet. In synchronous with the recording operation, the recording sheet 206 is supplied by a sheet supply motor (not shown), a sheet supply roller (not shown) and a sheet hold-down plate 209. In an inoperative condition or when a recovery operation is performed, the recording apparatus is capped by a cap (not shown).

A wiper 110 serves to clean a face surface (ink discharge surface) of the recording head 202 thereby to remove the ink and foreign matters adhered to the face surface after the recovery operation or during the recording operation. The wiper 110 is normally retracted to a position where the wiper is not contacted with the head. When a wiping operation is performed, the wiper is advanced to be contacted with the face surface of the head 202 shifted together with the carriage 200.

Next, the wiping operation for cleaning the ink jet head unit attached to the recording apparatus will be explained.

Figure 5:
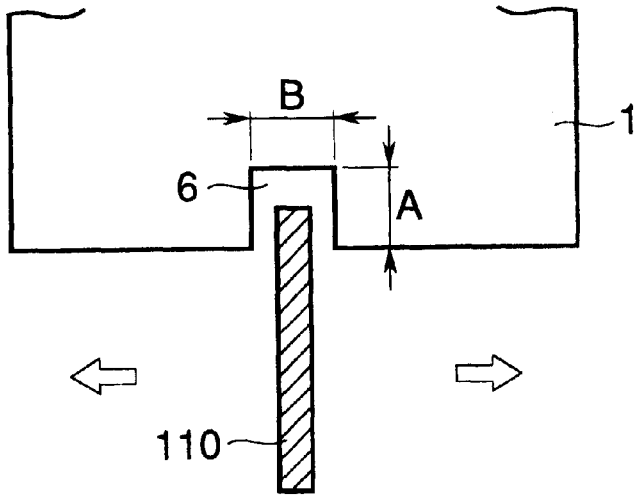
FIGS. 5, 6 and 7 are explanatory views showing a wiping operation according to the first embodiment.

When the wiping operation is performed, in synchronous with the head shifted together with the carriage, as shown in FIG. 5, the wiper 110 as a wiping member is advanced to a wiping position where the wiper is entered into the recess 6 of the top plate 1. When the carriage is further shifted, a face surface portion of the top plate 1 positioned at one side of the recess is wiped. When the carriage is shifted to an opposite direction, a face surface of the top plate positioned at the other side of the recess is similarly wiped.

As shown by the arrows in FIG. 5, since the wiping directions for two rows of nozzles (ink discharge ports) are different from each other, color mixing and consumption of ink in preliminary ink discharge for eliminating the color mixing can be prevented. Further, either of two rows of nozzles can be wiped as desired, a service life of the face surface can be enhanced. Particularly when the recording ink is associated with one of two rows of nozzles and treatment liquid which reacts with the ink to improve the image quality and water-proof ability is associated with the other row of nozzles, since the treatment liquid reacts with the ink if they are contacted with each other, two wiping members may be provided so that one of the wiping members wipes one of the face surface portions in one direction and the other wiping member wipes the other face surface portion in the opposite direction.

In the wiping operation, since the face surface portion is wiped by the wiper 110 after the wiper 110 is contacted with the edge of the recess 6, the ink adhered to the wiper 110 is removed from the wiper by the edge of the recess to be held in the recess 6. Thus, the face surface can be wiped by the wiper 110 always maintained in a cleaned condition.

Figure 6:
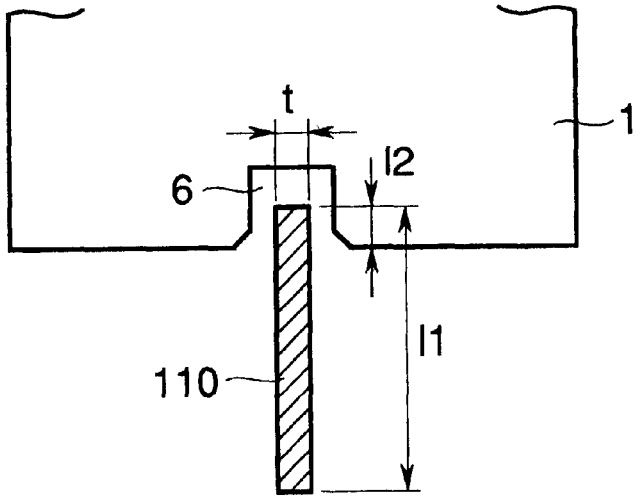

Further, as shown in FIG. 6, both edges of the recess may be chamfered. The chamfered portions act as entrance guides for the wiper 110 and serve to prevent the wiper 110 from being damaged by the edges of the recess. In place of the chamfer the edges may be rounded.

In FIG. 6, "*l*1" denotes a deformable area (free length) of the wiper, "*l*2" denotes a penetrate amount of the wiper into the recess, and "t" denotes a thickness of the wiper. The wiping ability for the face surface mainly depends upon the above parameters. That is to say, the longer the free end and/or the smaller the penetrate amount and/or the smaller the thickness, the smaller the urging force of the wiper acting against the face surface; whereas, the shorter the free end and/or the greater the penetrate amount and/or the greater the thickness, the greater the urging force of the wiper acting against the face surface. If the urging force is too poor, the ink cannot be removed from the face surface completely, and, if the urging force is too great, the wiper will be deformed excessively and not remove the ink from the face surface completely and the face surface will be damaged.

According to the effected by the inventor, it was found that, when the wiper is made of urethane, the free end is selected to 4 mm and the thickness is selected to 0.3 mm, the optimum penetrate amount is in a range from 0.4 mm to 1.5 mm. Further, since the penetrate amount is determined by a positional relation between the head and the wiper, it is desirable that the penetrate amount is selected to be greater than 4.0 mm in consideration of dispersion. In addition, it was found that the thickness of the wiper is preferably 15 mm or more and the penetrate amount is preferably 2 mm or more.

Further, in order not to prevent the wiper 110 from penetrating into the recess 6 of the top plate 1, as shown in FIG. 5, a depth (A) of the recess is preferably selected to 0.3 mm or more and a width (B) of the recess is preferably selected to 0.5 mm or more.

Figure 7:
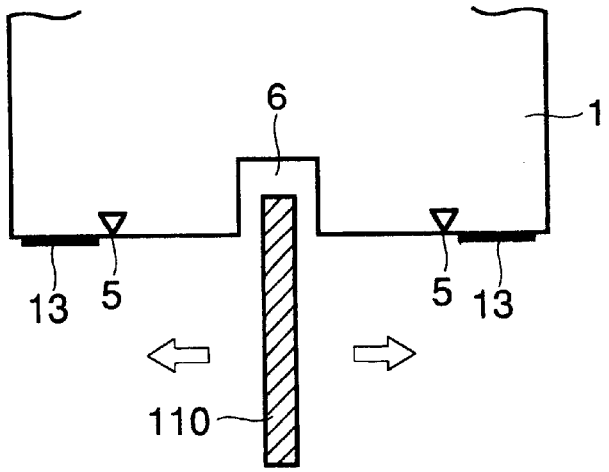

A head provided at its face surface with a water-repellent area for preventing deviation of an ink discharging angle due to leakage of ink and a hydrophilic area for trapping the ink droplets adhered to the face surface is generally known. A preferred embodiment in which hydrophilic areas 13 are provided on the face surface of the top plate 1 is shown in FIG. 7.

In this embodiment, as is in the embodiment shown in FIG. 5, the wiping operation of the wiper 110 is effected from the center of the top plate 1 toward the either of two rows of nozzles (ink discharge ports) 5. In this case, as shown in FIG. 7, the hydrophilic areas 13 are disposed outwardly of the respective rows of nozzles 5 (near ends of the top plate). With this arrangement, since each hydrophilic area 13 in which foreign matters such as solidified ink are apt to be accumulated is disposed at a downstream side of the corresponding nozzle row in the wiping direction, there is no danger of penetrating the foreign matters into the nozzles by the wiper 110. In this embodiment, while an example that there are provided two hydrophilic areas 13 associated with the respective rows of nozzles was explained, only a single hydrophilic area 13 may be provided on the face surface.

[Second Embodiment]

Figure 8:
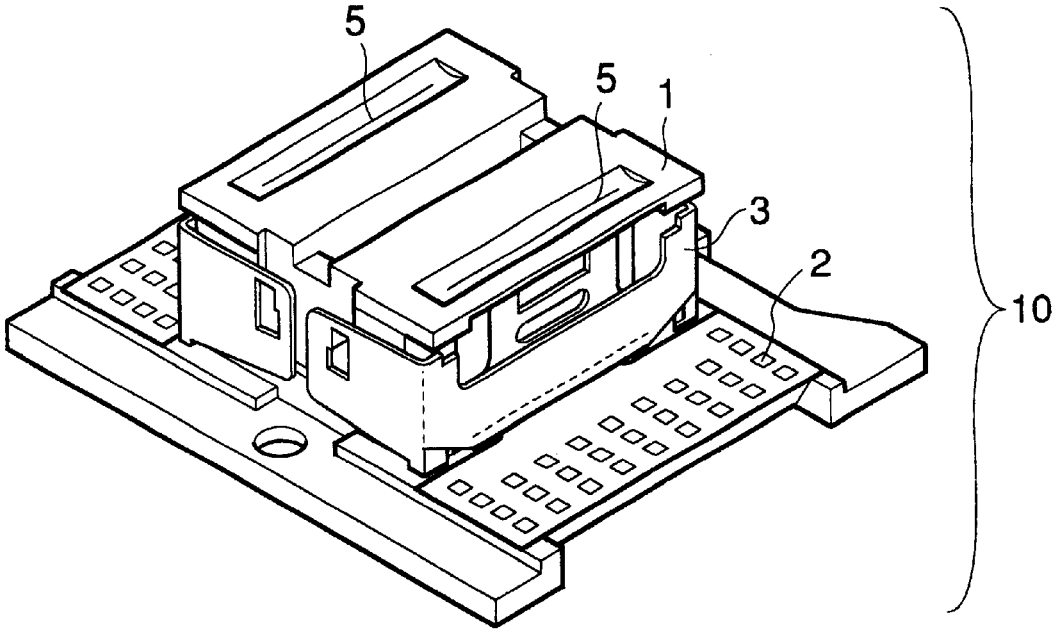
FIG. 8 is a schematic perspective view of an ink jet recording head according to a second embodiment of the present invention.
Figure 9:
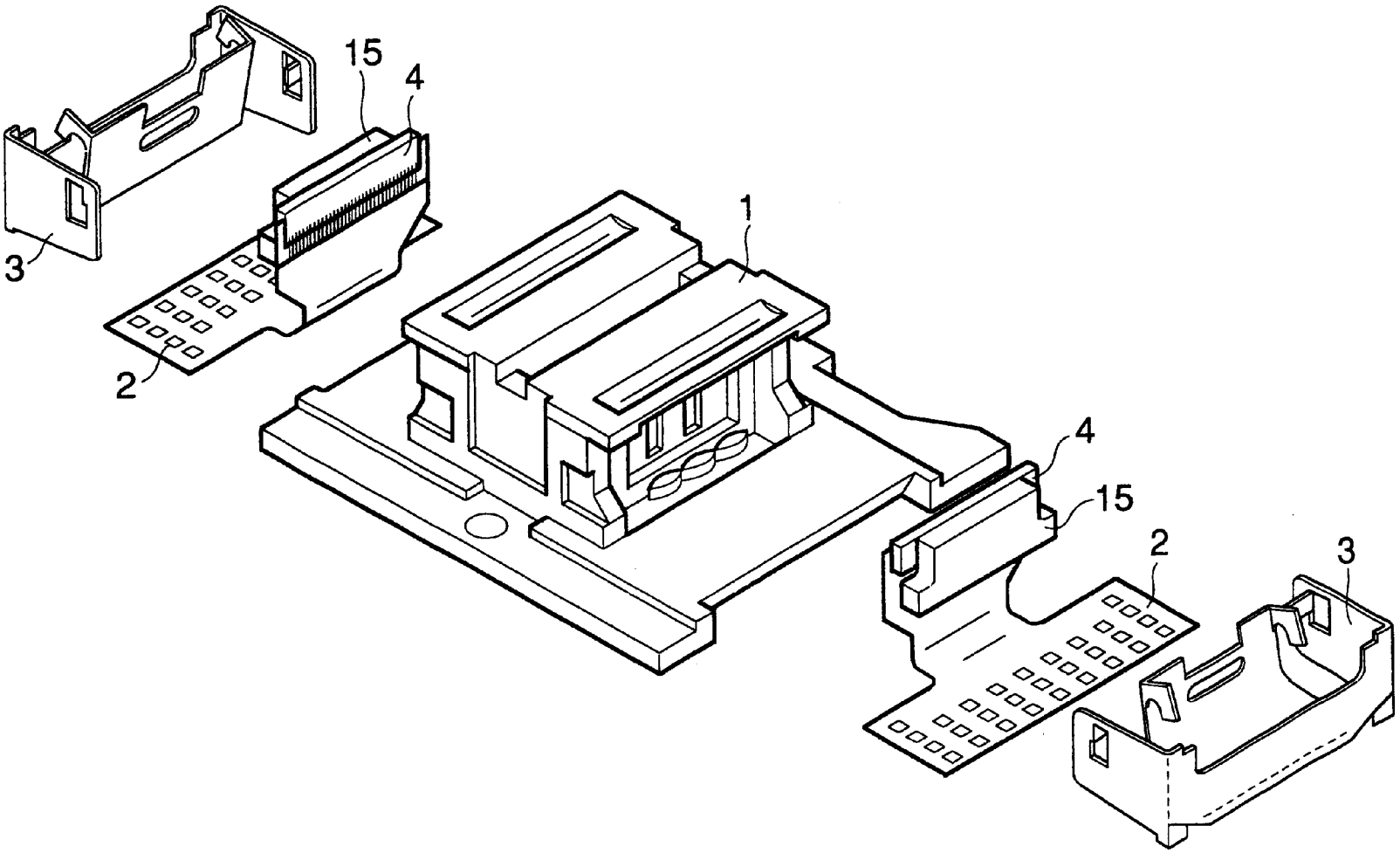
FIG. 9 is an exploded perspective view of the ink jet recording head of FIG. 2.
Figure 10:
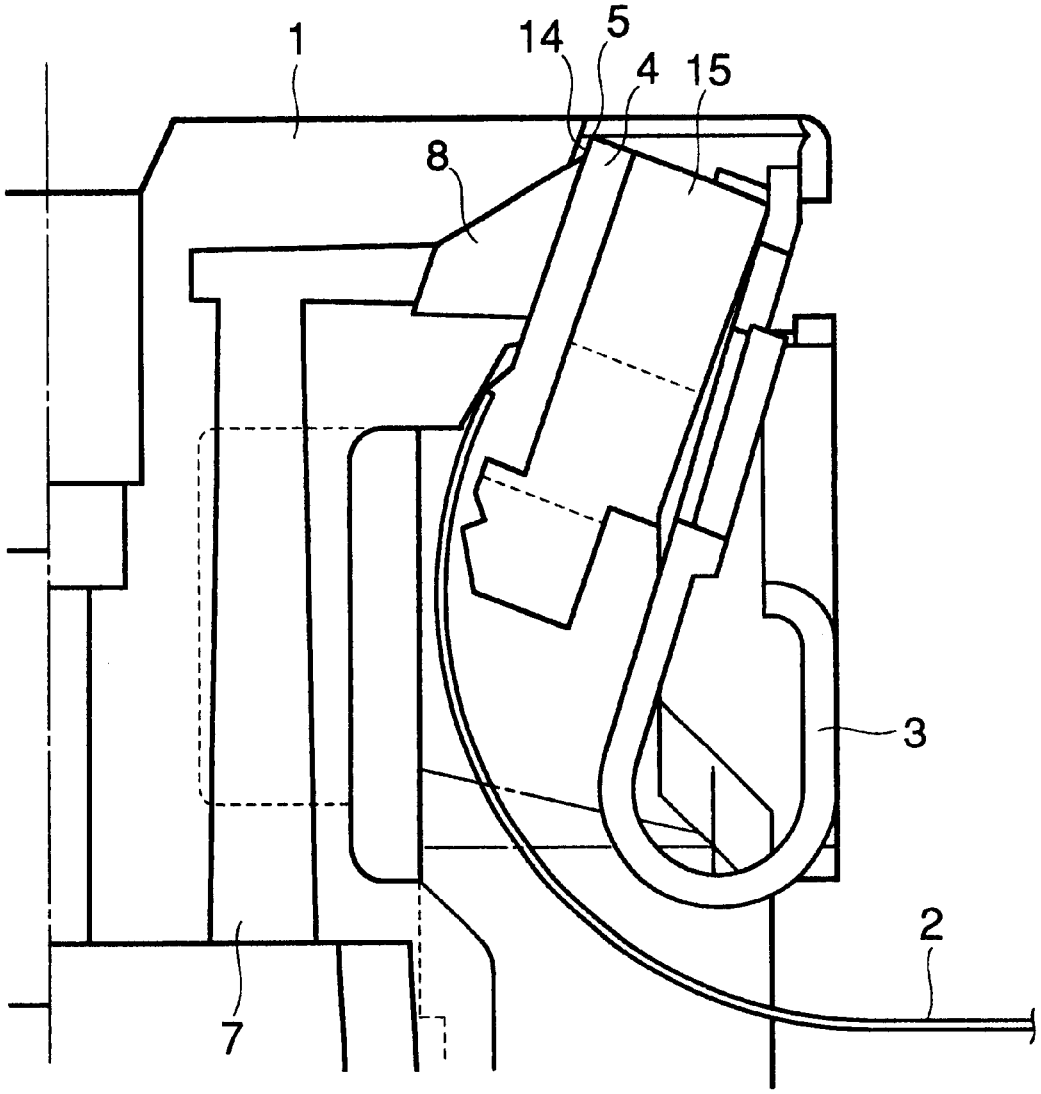
FIG. 10 is a sectional view showing an inner structure and ink passages of the ink jet recording head according to the second embodiment.

FIGS. 8 to 10 correspond to FIGS. 1 to 3 and show an ink jet recording head 10 according to a second embodiment of the present invention and an ink jet cartridge on which the ink jet recording head is mounted. In FIGS. 8 to 10, the main structures of the head and cartridge are substantially the same as those in the first embodiment, and the same or similar elements as those in the first embodiment are designated by the same reference numerals.

Now, the second embodiment will be explained. Ink passage grooves (defining ink passages), ink chambers and ink discharge ports are previously formed in a top plate 1. Substrates on which resistive heat generating elements are mounted are electrically connected to a carriage by wiring substrates 2. The substrates having the heat generating elements are urged against and secured to the top plate 1 by elastic members 3. Ink discharge ports 5 are formed in the top plate 1. In this embodiment, since two rows of ink discharge ports 5 can be formed symmetrically with each other and ink introduction passages are collectively formed at a certain position, the top plate can be manufactured and assembled more easily than a top plate having three or more rows of ink discharge ports.

FIG. 9 is an exploded perspective view showing a detailed structure of the ink jet head 10 of FIG. 2 to facilitate the understanding of parts and an assembling method therefor. The substrates 4 having the resistive heat generating elements are secured to respective metallic plates 15 by adhesive and are electrically connected to the respective wiring substrates 2. The wiring substrates 2 are secured to the metallic plates 15 by adhesive so that a bending force (generated when the wiring substrate is bent) does not act on the corresponding substrate 4 having the resistive heat generating elements.

FIG. 10 is a sectional view of the ink jet head 10 of FIG. 8, showing an internal structure thereof and ink passages. An ink introduction passage 7 serves to ink from an ink container to an ink chamber 8. The ink from the ink container passages through the ink introduction passage 7 and enters into the ink chamber 8 defined by the top plate 1 and the substrates 4 having the resistive heat generating elements, and then flows (from the ink chamber 8) into ink passages 14 within which the respective resistive heat generating elements are disposed. Film-boiling is caused in the ink in the ink passage by thermal energy from the resistive heat generating element, thereby discharging the ink from the discharge port 5.

In order to prevent the ink from leading from the ink chamber 8 defined by the top plate 1 and the substrates 4 having the resistive heat generating elements, interfaces between the top plate and the substrates are sealed by sealing agent. Further, sealing agent is applied to connection portions between the substrates 4 having the resistive heat generating elements and the wiring substrates 2, thereby preventing the ink from adhering to the connection portions.

The top plate 1 is formed by molding, and the ink discharge ports 5, ink passages 14, ink chambers and ink introduction passages 7 are formed by molding or laser-working. The ink discharge ports 5 and the ink passages 14 must be formed with high accuracy. When angular deviation of the ink discharge ports 5 in each row with respect to the ink discharging direction is minimized, the distances between the ink discharge ports 5 and the recording material are changed, since the relative adhesion points of the ink droplets (onto the recording material) from each row are unchanged, electrical correction can be omitted, and, thus, electrical simplicity can be achieved. To this end, surface-finish around the ink discharge ports 5 is effected uniformly by enhancing the manufacturing accuracy. The molded parts are formed from material having good molding ability and good resistance to ink. In this respective, polysulfon is desirable, but other molding materials may be used.

The substrates 4 having the resistive heat generating elements serves to cause the film-boiling in the ink by utilizing thermal energy to effect the recording. The plurality of resistive heat generating elements arranged in a line and aluminum wirings for supplying electric power to the respective resistive heat generating elements are formed on the respective substrate made of silicon by a film-forming technique. Each substrate includes shift registers and driving transistors to reduce the number of TAB connecting pads. It is necessary that the substrates 4 and the top plate 1 are assembled with each other with high accuracy, because the correct ink discharge cannot be achieved unless the substrates 4 are correctly aligned with the ink discharge ports 5.

Each wiring substrate 2 serves to electrically connect the corresponding substrate 4 to the printer. One end of the wiring substrate 2 is connected to the corresponding substrate 4 via a TAB and the other end is provided with a connection pad portion for receiving an electrical signal from the printer. The connection pad portion is secured to the top plate 1 with high accuracy by adhesive. Hence, since the head can be handled as a single unit, the assembling can be facilitated, and the "recycle" is permitted. The substrates 4 having the resistive heat generating elements are secured to the top plate 1 by mechanical biasing forces of the elastic members 3.

FIG. 9 is a schematic perspective view showing an ink jet recording head unit having the ink jet recording head 10 according to the second embodiment. The ink jet recording head 10 is directly secured to a front face of the ink container (ink tank) 11 in a mounting direction (to the printer, i.e., the ink jet recording apparatus) so that the ink jet recording head can be detachably mounted to the ink jet recording apparatus.

[Third Embodiment]

Prior to detailed explanation of a third embodiment of the present invention, a fundamental structure and constructural elements of an ink jet recording head to which the present invention is applied will be described.

The third embodiment relates to an ink jet unit in which an ink tank and an ink jet recording head can be detachably mounted on a carriage, and four main functional portions are provided on surfaces of the recording head. These functional portions include (a) a portion for receiving an electrical signal from the printer (referred to as "electrical connection portion" hereinafter), (b) a portion for receiving ink from the ink tank (referred to as "ink supply portion" hereinafter), (c) a portion for discharging the ink (referred to as "ink discharge portion" hereinafter), and (d) a portion for positioning the ink jet recording head with respect to the carriage (referred to as "positioning portion" hereinafter).

It is desirable that the four functional portions are constituted in consideration of the following conditions, to improve the reliability of the ink jet recording head, image quality and replacing ability of the ink jet recording head and the ink tank.

If the ink supply portion or the electrical connection portion is provided on the same surface on which the ink discharge portion is provided, mist of ink discharged from the ink discharge portion is scattered onto the electrical connection portion to cause "short circuit" due to conductivity of the ink mist, or paper powder from the recording material (disposed near the electrical connection portion) adhered to the electrical connection portion causes poor electrical contact.

When the ink jet recording head or the ink tank is mounted and dismounted, a mounting force and a dismounting force are applied to the carriage and the ink jet recording head. If the ink jet recording head is displaced by such load, the correct position of the ink jet recording head cannot be ensured, with the result that the correct adhering points of the ink droplets cannot be ensured, thereby deteriorating the image quality.

In the manufacture of the head, the ink jet recording heads for effecting the color recording must be assembled with each other accurately.

Figure 11:
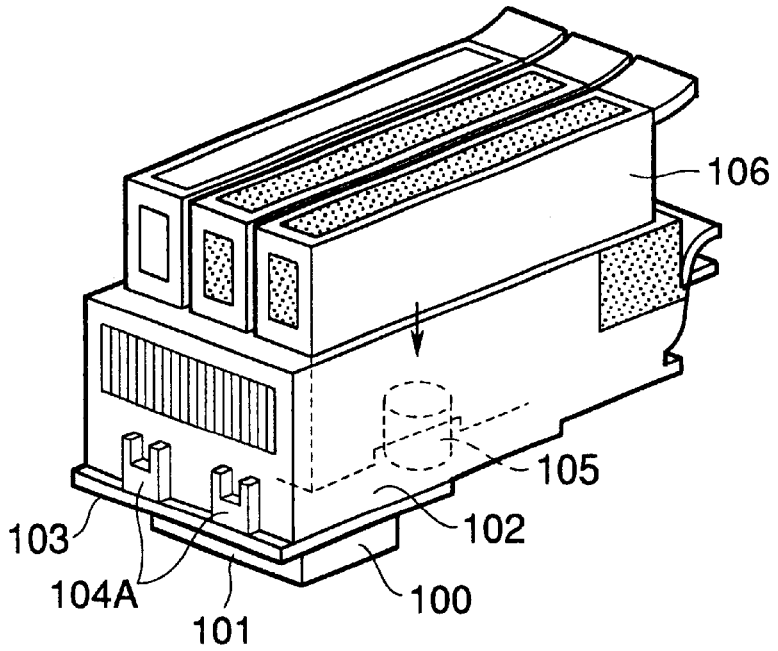
FIG. 11 is a perspective view of an ink jet recording head according to a third embodiment of the present invention.

An example of an ink tank and an ink jet recording head according to the third embodiment constructed in consideration of the above conditions is shown in FIG. 11.

In FIG. 11, an ink jet recording head 100 includes ink discharge portions 101, a holder 102 and electrical connection portions 103. An ink tank 106 is connected to an ink supply pipe 105 arranged in the ink discharging direction (perpendicular to the electrical connection portion) at the holder 102 to which the ink jet recording head 100 is secured, thereby permitting the ink supply.

Figure 12:
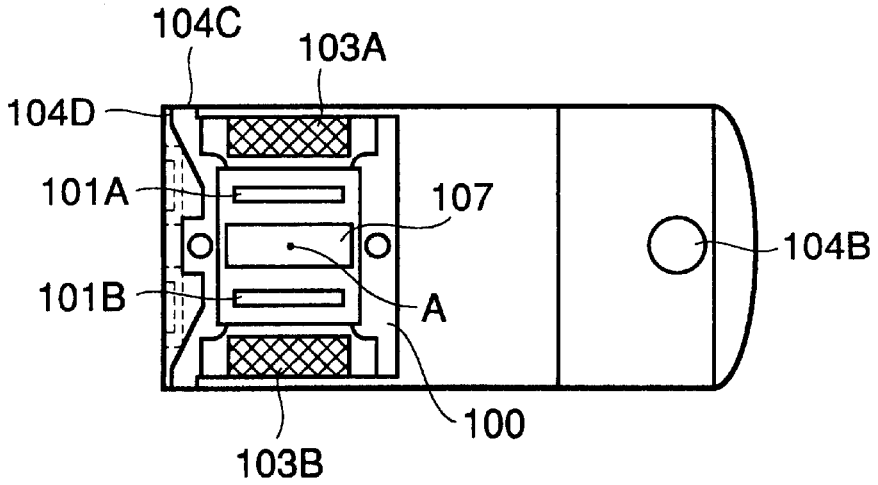
FIG. 12 is a view looked at from an ink discharging direction in FIG. 11.

FIG. 12 is a view looked at from the ink discharging direction of the ink jet unit shown in FIG. 11. The ink discharge portions 101 and the electrical connection portions 103 are disposed at positions 101A, 101B and 103A, 103B symmetrically around a rotational center A. Positioning portions 104C and 104D are provided at a corner of the ink jet recording head 100 and serve to position the ink jet recording head 100 in X and Y directions. The positioning of the ink jet recording head in a Z direction is effected by positioning portions 104A (FIG. 11) and 104B (FIG. 12). A groove 107 is formed between the ink discharge portions 101A and 101B and a length of the groove is greater than lengths of the ink discharge portions.

In the illustrated embodiment, constructural elements of the recording head are arranged on the recording head to satisfy the following conditions. That is to say, the ink discharge portions are not provided on the same surfaces on which the ink supply portions and the electrical connection portions are provided. In this way, mist of ink discharged from the ink discharge portion is prevented from being scattered onto the electrical connection portion thereby to prevent "short circuit" due to conductivity of the ink mist, and, since the electrical connection portions are disposed remote from the recording material, paper powder from the recording material (disposed near the electrical connection portion) is prevented from being adhered to the electrical connection portions thereby to prevent the poor electrical contact.

Particularly, in the illustrated embodiment, since the electrical connection portions are provided in a plane perpendicular to an ink discharging portion of said head or inclined with respect to the ink discharging direction by ±5 degrees or less and the ink discharge surfaces are protruded from the electrical connection surfaces by 5 mm or more, by utilizing such step (height difference) as an electrical connecting portion of the carriage of the printer, protection walls for shielding the ink mist and paper powder can be obtained.

Further, when two rows of ink discharge portions are provided with respect to the main scan direction to effect the color recording, by arranging the first row ink discharge portion and the associated electrical connection surface and the second row ink discharge portion and the associated electrical connection surface symmetrically at positions rotated by 180 degrees with respect to the center between the rows, the "cost-down" can be achieved because common parts can be used.

By providing the groove having the length greater than those of the ink discharge portions between the first and second row ink discharge portions, the color mixing can be prevented.

Since the ink supply portion such as the ink tank is connected to the head along the ink discharging direction, when the ink tank is replaced (dismounted and mounted), the load acting on the head is distributed symmetrically and uniformly at outside areas of the ink discharge port rows, thereby preventing the positional deviation of the head which would affect a bad influence upon the color recording.

As mentioned above, according to the present invention, the following advantages can be obtained.

(1) In the ink jet recording head, the plurality of substrates having the resistive heat generating elements are urged against the top plate having the ink passages and the ink chambers by means of the elastic members. By manufacturing the top plate accurately and by forming the ink discharge ports with high accuracy by a laser beam by utilizing a reference surface formed on the top plate as a reference, color deviation can be prevented to improve recording quality and image quality, the number of parts can be reduced, an assembling time can be shortened, reliability and yield can be improved, and size can be reduced to provide a compact printer. Further, since the plurality of substrates having resistive heat generating elements are used, high speed recording can be achieved.

In addition, since the groove (recess) having the depth greater than those of the ink discharge portions (ink discharge ports and the ink passages) is formed between the ink discharge port rows of the top plate, the substrates can be closely contacted with the top plate effectively by deforming the portions of the top plate corresponding to the substrates.

(2) Since the ink discharge surfaces are not flush with the electrical connection surfaces and the ink supply surfaces but are protruded by 5 mm or more, reliability can be improved, and, by arranging two ink discharge port rows symmetrically at positions rotated by 180 degrees with respect to the rotational center between the rows, "cost-down" can be achieved because common parts can be used. Further, by connecting the ink supply portions to the head along the ink discharge direction, when the ink tank is mounted on and dismounted from the head, load acting on the head is distributed uniformly outside of the rows of the ink discharge ports, thereby preventing positional deviation of the head which would affect a bad influence upon the color recording.

(3) By providing the recess (into which the wiping member can penetrated) in the central portion of the top plate having two rows of nozzles, the color mixing and poor cleaning can be prevented, and the number of wiping operations can be minimized, thereby preventing the damage of the face surface and increasing the service life of the wiping member.

What is claimed is:

1. An ink jet recording head comprising:

a top plate made of a resin having a discharge port surface which includes an array of ink discharge ports, and in which two groups of ink passage grooves for forming ink passages, two ink chamber frames, ink introduction passages, and two rows of said ink discharge ports are formed, the grooves being provided on the discharge port surface;

two substrates on which a plurality of resistive heat generating elements for discharging ink are formed in correspondence with said two rows of ink discharge ports; and two elastic members contacting under pressure and securing said substrates and said top plate for each said substrate, wherein the junction between said substrates and said top plate forms said ink passages and said ink chambers therebetween and wherein a groove is formed between said ink discharge port rows and a depth of said groove is greater than depths of said ink discharge ports and said ink passages, wherein said depth of said groove allows said top plate to deform so as to improve contact between said top plate and said two substrates.

2. An ink jet recording head according to claim 1, wherein flexible wiring substrates having connection pads for electrically connecting said substrates to a carriage are connected to said substrates and said wiring substrates are secured to said top plate.

3. An ink jet recording head according to claim 1, wherein said top plate is molded from resin.

4. An ink jet recording head according to claim 1, wherein said elastic members are provided with metallic plates.

5. An ink jet recording head according to claim 2, wherein said elastic members are provided with metallic plates, and said wiring substrates are secured to said top plate and said metallic plates.

6. An ink jet recording head according to any one of claims 1 to 5, wherein ink discharging directions of said ink discharge port rows are directed to the same direction with angular error of ±2 degrees or less.

7. An ink jet recording apparatus comprising:

an ink jet recording head according to claim 6; and a wiping member for cleaning a discharge port surface of said top plate of said recording head in which said ink discharge ports are formed.

8. An ink jet recording head according to claim 1, further comprising a first row ink discharge surface and a second row ink discharge surface, and wherein said first and said second row ink discharge surfaces are provided with a particular orientation relative to a main scan direction, and, the first row ink discharge surface an associated electrical connection surface, and the second row ink discharge surface and an associated electrical connection surface are arranged symmetrically at positions rotated by 180 degrees with respect to a center between said rows.

9. An ink jet recording apparatus comprising:

an ink jet recording head according to claim 8; and a wiping member for cleaning a discharge port surface of said top plate of said recording head in which said ink discharge ports are formed.

10. An ink jet recording head according to claim 1, wherein the depth of said groove is 0.3 mm or more, and a width of said groove is 0.5 mm or more.

11. An ink jet recording apparatus comprising:

an ink jet recording head according to claim 10; and a wiping member for cleaning a discharge port surface of said top plate of said recording head in which said ink discharge ports are formed.

12. An ink jet recording head according to claim 1, wherein ribs extending in a direction perpendicular to the ink discharge port rows are provided at both ends of said groove.

13. An ink jet recording apparatus comprising:

an ink jet recording head according to claim 12; and a wiping member for cleaning a discharge port surface of said top plate of said recording head in which said ink discharge ports are formed.

14. An ink jet recording head according to claim 1, wherein a wedge member is provided substantially at a central portion of said groove.

15. An ink jet recording head according to claim 14, wherein said wedge member and said top plate are made from a same material.

16. An ink jet recording apparatus comprising:

an ink jet recording head according to claim 15; and a wiping member for cleaning a discharge port surface of said top plate of said recording head in which said ink discharge ports are formed.

17. An ink jet recording apparatus comprising:

an ink jet recording head according to claim 14; and a wiping member for cleaning a discharged port surface of said top plate of said recording head in which said ink discharged ports are formed.

18. An ink recording apparatus comprising:

an ink jet recording head according to any one of claims 1 to 5; and a wiping member for cleaning a discharge port surface of said top plate of said recording head in which said ink discharge ports are formed.

19. An ink jet recording apparatus according to claim 18, wherein said wiping member is penetrated into said groove when said discharge port surface is cleaned by said wiping member.

20. An ink jet recording apparatus according to claim 19, wherein a shifting direction of said wiping member for cleaning one of said ink discharge port rows differs from a shifting direction of said wiping member for cleaning the other ink discharge port row.

21. An ink jet recording apparatus comprising:

an ink jet recording head according to claim 1; and a wiping member for cleaning a discharge port surface of said top plate of said recording head in which said ink discharge ports are formed.

* * * * *